US005365846A

United States Patent [19]

Becker

[11] Patent Number: 5,365,846

[45] Date of Patent: Nov. 22, 1994

[54] FORMAT-ADJUSTABLE SHEET-TURNING DEVICE WITH CHANGE-OVER GEARS ON A SHEET-FED ROTARY PRINTING PRESS

[75] Inventor: Willi Becker, Bammental, Germany

[73] Assignee: Heidelberger Druckmaschinen AG, Heidelberg, Germany

[21] Appl. No.: 124,164

[22] Filed: Sep. 20, 1993

[30] Foreign Application Priority Data

Sep. 18, 1992 [DE] Germany ..... 4231257

[51] Int. Cl.[5] ..... B41F 5/02

[52] U.S. Cl. ..... 101/230; 101/409; 101/183

[58] Field of Search ..... 101/212, 216, 230, 231, 101/183, 184, 229, 232, 409, 410; 271/902, 225

[56] References Cited

U.S. PATENT DOCUMENTS

| | | | |
|---|---|---|---|
| 3,654,861 | 4/1972 | Rudolph et al. | 101/409 |
| 3,992,993 | 11/1976 | Kuhn et al. | 101/409 |
| 4,014,261 | 3/1977 | Becker | 101/230 |
| 4,018,161 | 4/1977 | Johne et al. | 101/231 |
| 4,122,773 | 10/1978 | Wirz | 101/230 |
| 4,628,817 | 12/1986 | Trinks et al. | 101/230 |
| 5,063,843 | 11/1991 | Becker | 101/183 |
| 5,249,521 | 10/1993 | Kobler | 101/230 |

FOREIGN PATENT DOCUMENTS

| | | |
|---|---|---|
| 135812 | 5/1979 | German Dem. Rep. . |
| 226517 | 8/1985 | German Dem. Rep. . |
| 2023510 | 2/1972 | Germany . |
| 3017013 | 11/1983 | Germany . |
| 1393933 | 5/1975 | United Kingdom . |
| 2202828 | 10/1988 | United Kingdom . |

*Primary Examiner*—Eugene H. Eickholt
*Attorney, Agent, or Firm*—Herbert L. Lerner; Laurence A. Greenberg

[57] ABSTRACT

Sheet-fed rotary printing press for making one-sided multi-color prints or recto-and-verso prints, having at least one multi-size, driven sheet-guiding cylinder disposed between impression cylinders of two printing units, devices adjustable to a sheet-length format, and gripper systems associated with the cylinders, includes at least two intermediate gears via which a drive of the cylinders is divertable, at least one of the intermediate gears being formed as a single-revolution double intermediate gear having an adjustable ring gear and a gearwheel.

14 Claims, 6 Drawing Sheets

FORMAT-ADJUSTABLE SHEET-TURNING DEVICE WITH CHANGE-OVER GEARS ON A SHEET-FED ROTARY PRINTING PRESS

The invention relates to a sheet-size or format-adjustable turning device with change-over gears on a sheet-fed rotary printing press.

A device for adjusting the drive of first-form and perfecting presses has become known heretofore from published German Patent Document 31 36 34 9 A1, wherein a first and a second gearwheel are hydraulically clamped together. By externally operatable actuating or adjusting elements, the rotatable connection of the gearwheels can again be released or disconnected.

Published British Patent Document 21 08 091 A describes an adjusting mechanism for sheet-fed rotary printing presses with a turning device. Mounted on the journal of a turning drum in a manner so as to be adjustable relative to one another are a half-turn gearwheel as well as a half-turn ring gear. The latter are clamped against one another in a force-locking connection by a plurality of levers. In this regard, it is noted that a force-locking connection is one which connects two elements together by force external to the elements, as opposed to a form-locking connection which is provided by the shapes of the elements themselves. If use is made of half-turn gearwheels and ring gear for the change-over or conversion of a turning device, then concentricity errors of the gearwheel and the ring gear as well as any existing play have, of necessity, a periodic effect upon the printed image through the occurrence of ghosting. This applies as well to gear-pitch errors during the manufacture of half-turn ring gears and gearwheels. When format adjustments are made on half-turn ring gears and gearwheels, there is a relocation of manufacture-related concentricity errors. With an unfavorable summation of such concentricity errors, the result will be performance and rolling differences, in the case of multi-size sheet-guiding cylinders and, because at least two sheets are transported per cylinder in the case of multi-size cylinders, periodically occurring ghosting. If, for example, the sheet-guiding cylinders are of double-size diameter and if two sheets are transported, ghosting will occur towards the leading edge on one of them and towards the trailing edge on the other; depending upon rolling differences, which arise randomly during format adjustment due to the coincidence of concentricity errors.

Published German Patent Document 37 10 257 C2 discloses a device for sheet transfer during multi-color printing in recto or recto/verso printing, i.e., single side or first form and perfector printing, on sheet-fed rotary printing presses. With such a device, the change-over or conversion from recto to recto/verso printing as well as the format adjustment are likewise performed on half-turn change-over gearwheels. Furthermore, the specifications for the gap through which the grippers pass between the impression cylinder and the storage drum calls for a gearing correction. The size of the gap between the impression cylinder and the storage drum is restricted by gearing-correction limits. If the gap is narrow, the grippers which pass through the gap may be constructed only with limited stability.

It is accordingly an object of the invention to provide a turning cylinder of the foregoing general type which, however, overcomes the aforementioned disadvantages of the heretofore known turning cylinders.

It is also object of the invention is to optimize a turning device with double and multi-size transfer and turning cylinders so that ghosting-free printed products are assured, irrespective of change-over and format adjustment, respectively.

With the foregoing and other objects in view, there is provided, in accordance with the invention, a sheet-fed rotary printing press for making one-sided multi-color prints or recto-and-verso prints, having at least one multi-size, driven sheet-guiding cylinder disposed between impression cylinders of two printing units, devices adjustable to a sheet-length format, and gripper systems associated with the cylinders, comprising at least two intermediate gears via which a drive of the cylinders is divertable, at least one of the intermediate gears being formed as a single-revolution double intermediate gear having an adjustable ring gear and a gearwheel.

The manifold advantages achievable with this construction include, for one, that it is possible to prevent ghosting in the printed product when using single-revolution gearwheels for change-over. Any possibly occurring positional errors are imprinted in an identical position on each printed sheet to be transported, with the result that such errors are invisible in the printed product. Periodically occurring ghosting, of the kind that may occur when using half-revolution or smaller-revolution change-over gearwheels, with the unfavorable coincidence of take-up play or concentricity tolerances, can be eliminated when using single-revolution gearwheels for change-over. Furthermore, gearing corrections can be dispensed with. Moreover, in the case of single-revolution gearwheels, concentricity errors and tooth-pitch errors have no effect upon the printed product. If single-revolution gears are used, it is possible for them to be manufactured with larger tolerances and at lower cost. Due to the avoidance of gearing corrections, the size of the gap between the shells or jackets of sheet-guiding cylinders for the passage of a gripper, as well as the thickness and/or stability, respectively, of the gripper can be selected without limitation by the gearing-correction method.

In accordance with another feature of the invention, the one intermediate gear is formed as a single-revolution double intermediate gear for changeover and sheet-format adjustment.

In accordance with a further feature of the invention, the other of the two intermediate gears is formed as a single-revolution single intermediate gear.

In accordance with an added feature of the invention, the other of the two intermediate gears is formed as a half or slower-revolution intermediate gear.

In accordance with an additional feature of the invention, sheet-guiding cylinders are mounted in the printing press, and the one intermediate gear is formed as a change-over gear, both of the intermediate gears being disposed below the sheet-guiding cylinders.

In accordance with an alternative feature of the invention, sheet-guiding cylinders are mounted in the printing press, and the one intermediate gear is formed as a change-over gear, both of the intermediate gears being disposed above the sheet-guiding cylinders.

In accordance with yet another feature of the invention, the sheet-guiding cylinders have outer cylindrical surfaces and are mountable so that the outer cylindrical surfaces thereof define a gearing-independent gap therebetween as a passage for grippers.

In accordance with yet a further feature of the invention, the sheet-guiding cylinders have outer cylindrical surfaces and are mountable so that the outer cylindrical surfaces thereof define a gearing-independent gap therebetween as a passage for grippers.

In accordance with yet an additional feature of the invention, sheet-guiding cylinders and gears are mounted in the printing press, the sheet-guiding cylinders including an impression cylinder, a multi-size sheet-guiding cylinder formed as a storage drum, and a sheet-guiding cylinder serving as an impression and turning cylinder, and the gears including single-revolution intermediate gears, a drive of the sheet-guiding cylinders extending from the impression cylinder via the multi-size sheet-guiding cylinder formed as a storage drum, and via the single-revolution intermediate gears to the sheet-guiding cylinder serving as an impression and turning cylinder.

In accordance with still another feature of the invention, sheet-guiding cylinders and gears are mounted in the printing press, the gears including two intermediate gears, one of which serves as a change-over gear, the sheet-guiding cylinders having a drive separation therebetween, the drive separation being bridged by the intermediate gear serving as a change-over gear, and by the other of the two intermediate gears.

In accordance with still a further feature of the invention, sheet-guiding cylinders and gears are mounted in the printing press, the sheet-guiding cylinders including a sheet-guiding cylinder acting as a storage drum, and a sheet-guiding cylinder serving as an impression and turning cylinder of a down-line printing unit, and the gears including intermediate gears, the sheet-guiding cylinders having a drive separation therebetween, and including a drive bridging the drive separation, the drive extending from one of the sheet-guiding cylinders to the sheet-guiding cylinder acting as the storage drum, and via the intermediate gears to the sheet-guiding cylinder serving as the impression and turning cylinder of the downline printing unit.

In accordance with still an added feature of the invention, a plurality of multi-size sheet-guiding cylinders are disposed between the impression cylinders of the two printing units, the cylinders defining a drive separation therebetween, the drive separation being bridged by an intermediate gear acting as a change-over gear, as well as by another intermediate gear.

In accordance with a concomitant feature of the invention, a plurality of sheet-guiding cylinders are mounted in the printing press and define a drive separation therebetween, the drive separation being bridged by an intermediate gear constructed as a change-over gear, and by another intermediate gear.

Other features which are considered as characteristic for the invention are set forth in the appended claims.

Although the invention is illustrated and described herein as embodied in a format-adjustable sheet-turning device with change-over gearwheels on a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 4:
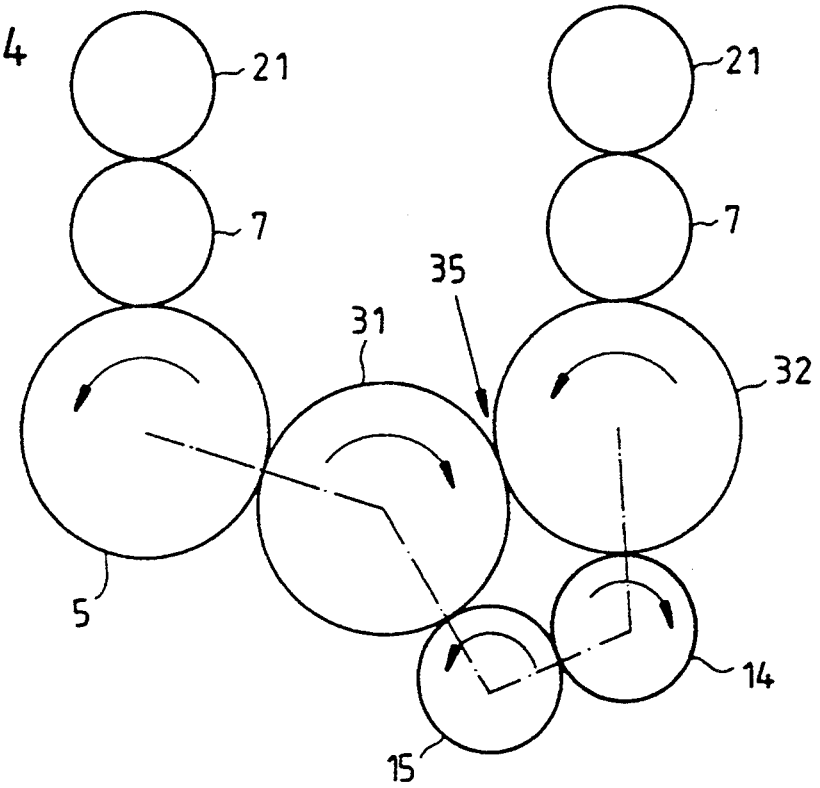
FIGS. 4 and 5 are reduced views similar to those of FIGS. 1 and 2 showing different embodiments of the invention having varying drive separations.
Figure 5:
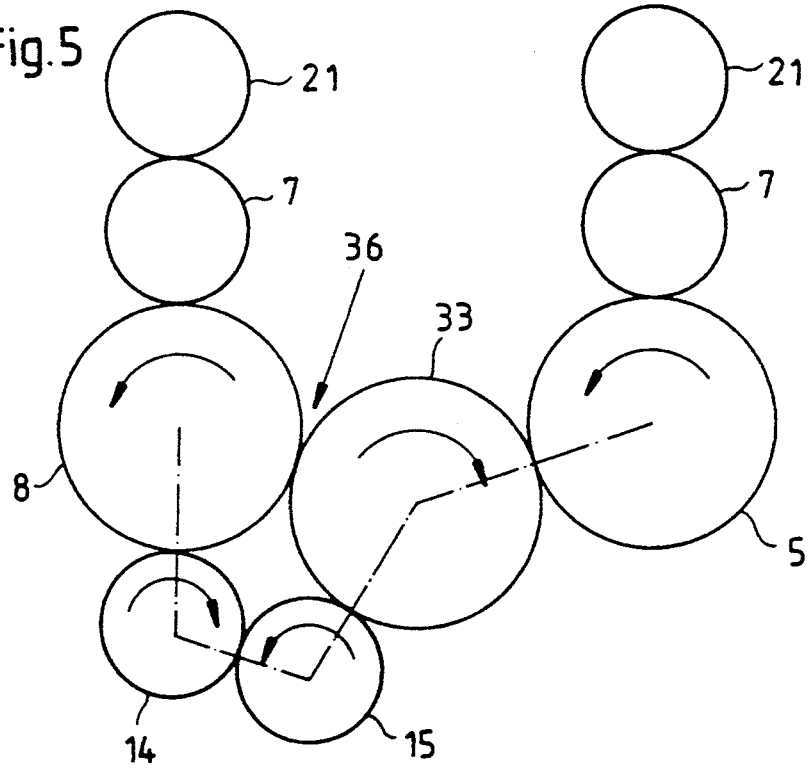
Figure 6:
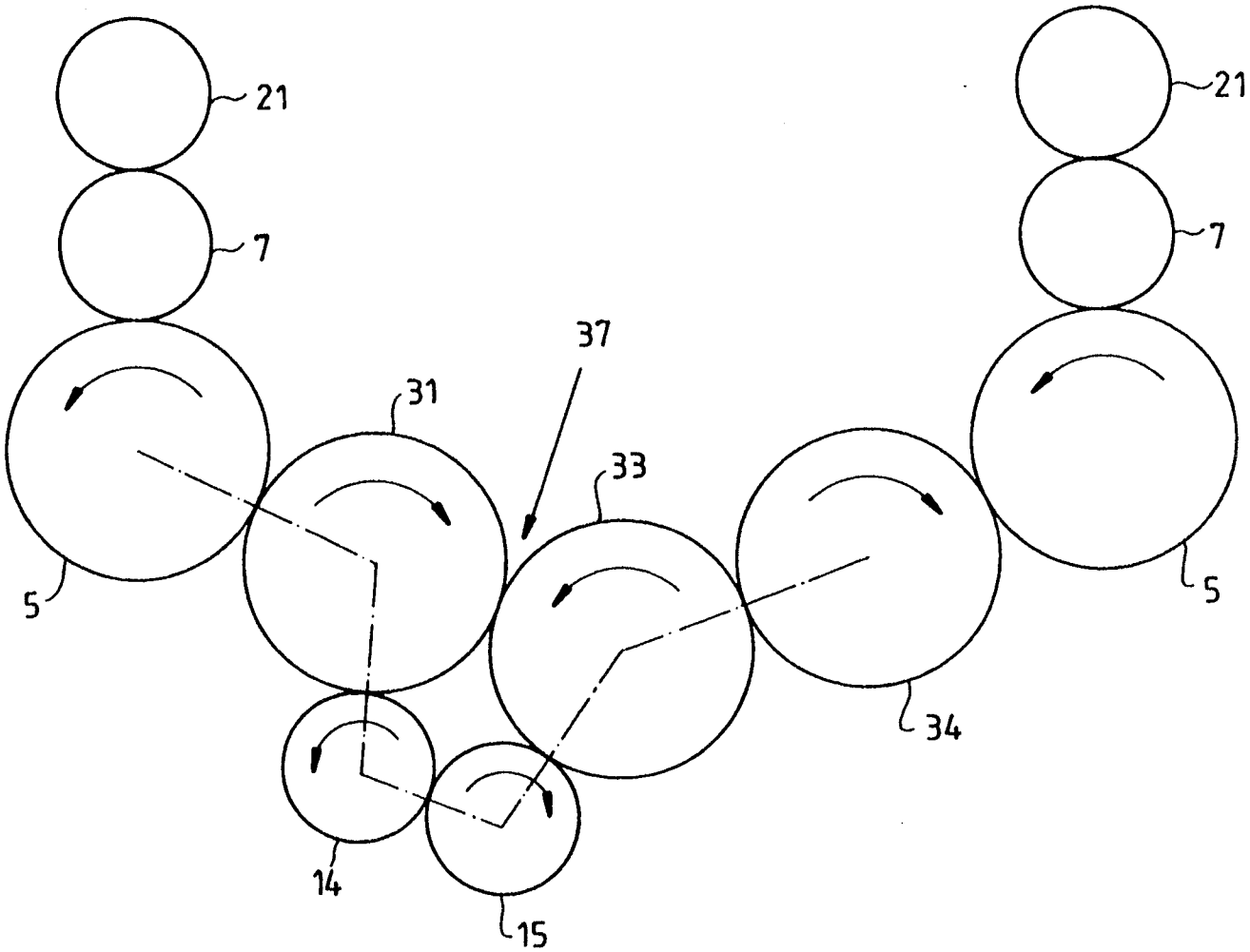
Figure 7:
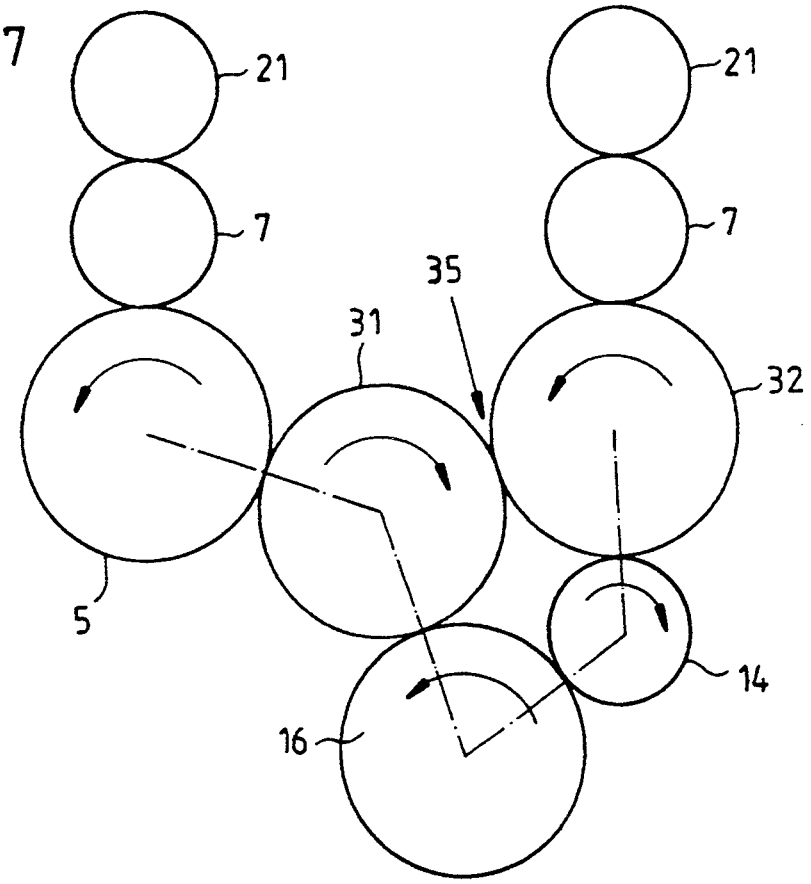
Figure 8:
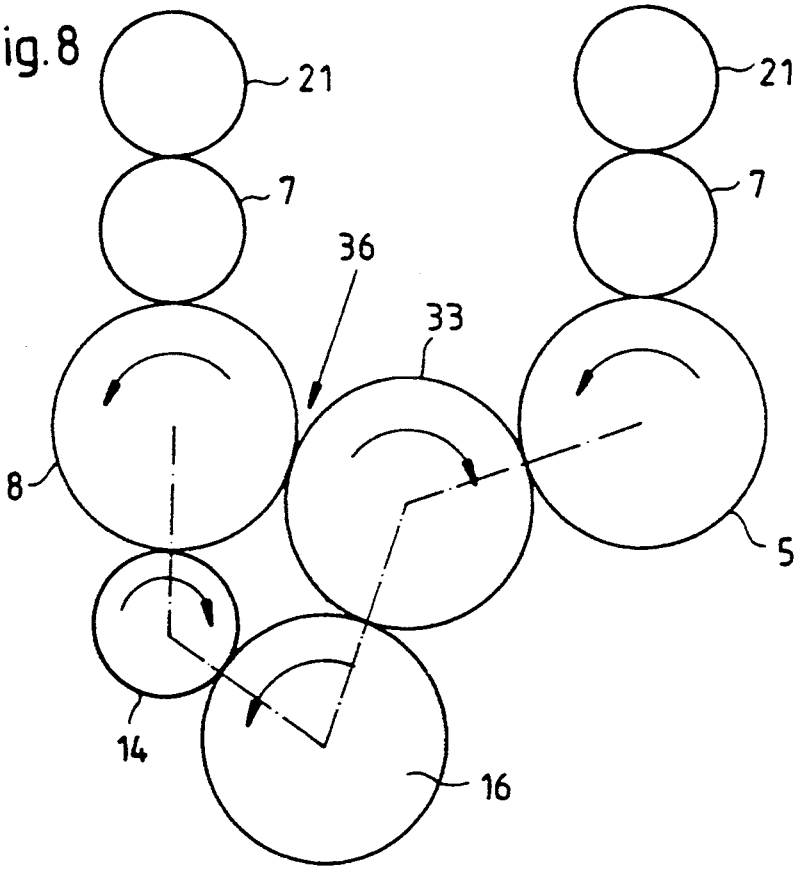

FIG. 6 is an enlarged view similar to those of FIGS. 4 and 5 of yet another embodiment of the invention having three double-size sheet-guiding cylinders of a turning apparatus between two printing units; and FIGS. 7 and 8 are views similar to those of FIGS. 4 and 5 of additional embodiments of the invention having turning devices with intermediate gears of different diameters.

Figure 1:
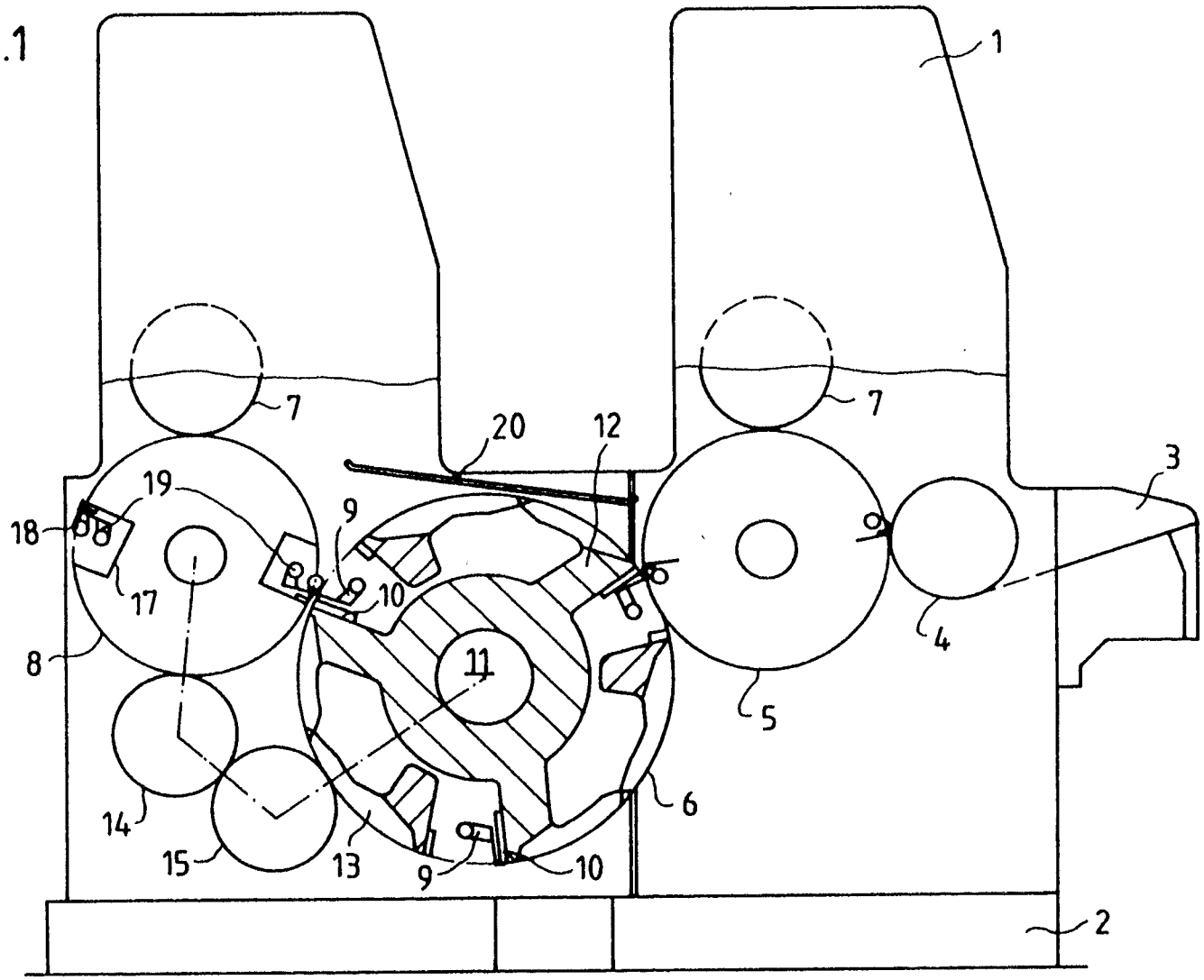
FIG. 1 is a diagrammatic side elevational view, partly in section, of two printing units with a triple-size sheet-guiding cylinder.

Referring now to the drawings and, first, particularly to FIG. 1 thereof, there is shown therein a partly cutaway side elevational view of two printing units with a triple-size sheet-guiding cylinder 6, as compared with the size of a conventional impression cylinder 5, for example. Printing units 1 are mounted on a base frame 2. Diagrammatically indicated on the first printing unit 1 is a paper-infeed slide 3, which supplies to a feeder drum 4 individual sheets which are to be printed. The sheets are taken from the feeder drum 4 by gripper bars of an impression cylinder 5, are held on the impression cylinder 5 and are printed by a rubber-blanket cylinder 7. Then, the printed sheets are taken over by clamp-type gripper bars 9 of the sheet-guiding cylinder 6 of so-called triple size in this embodiment before the sheets are transferred from the sheet-guiding cylinder 6 to a sheet-guiding cylinder 8, which serves as the impression and turning cylinder of the following printing unit. In FIGS. 1, 2, 4 and 5, the sheet-guiding cylinder 8 also serves likewise as an impression cylinder. The clamp-type gripper bars 9 of the sheet-guiding cylinder 6 take over the printed sheets from the impression cylinder 5 and hold them on pads 10. The sheet-guiding cylinder 6, which rotates about a rotary axis 11, is formed of jacket or shell segments 12 and shell fingers 13, which are capable of moving in a comb-like manner into and out of one another, and thereby being able to be adjusted to the sheet length format or size. The sheet-guiding cylinder 8 disposed behind the sheet-guiding cylinder 6 and acting as an impression cylinder, has two mutually opposite channels or gaps 17 formed therein, in each of which are disposed a gripper bar 19 as well as a pincers-type gripper bar 18, which accept the sheet, depending upon whether the printing press is operating in recto-printing mode or in recto-and-verso printing mode. In order to ensure that the individual grippers of the gripper bar 9 on the sheet-guiding cylinder 6, which acts as a storage drum, do not collide, in recto-and-verso printing mode, with the printing area of the sheet-guiding cylinder 8, which serves as an impression cylinder of the following printing unit, a gap is provided between the sheet-guiding cylinders 6 and 8.

In order to establish a driving connection between the sheet-guiding cylinders 6 and 8, a single-revolution double intermediate gear 14 and a single-revolution single intermediate gear 15 are situated below the aforementioned cylinders. Accordingly, the drive is effected along the phantom line shown in FIG. 1, the phantom line extending through the centers of the rotary axis 11, the single intermediate gear 15, and the double intermediate gear 14, as well as of the sheet-guiding cylinder 8. There is, therefore, no direct driving connection between the sheet-guiding cylinders 6 and 8. Situated above the sheet-guiding cylinder 6 is a guide plate 20, against the underside of which air jets are directed, which aid in the sheet transfer between the sheet-guiding cylinders, but which are not the subject of the invention of the instant application.

Figure 2:
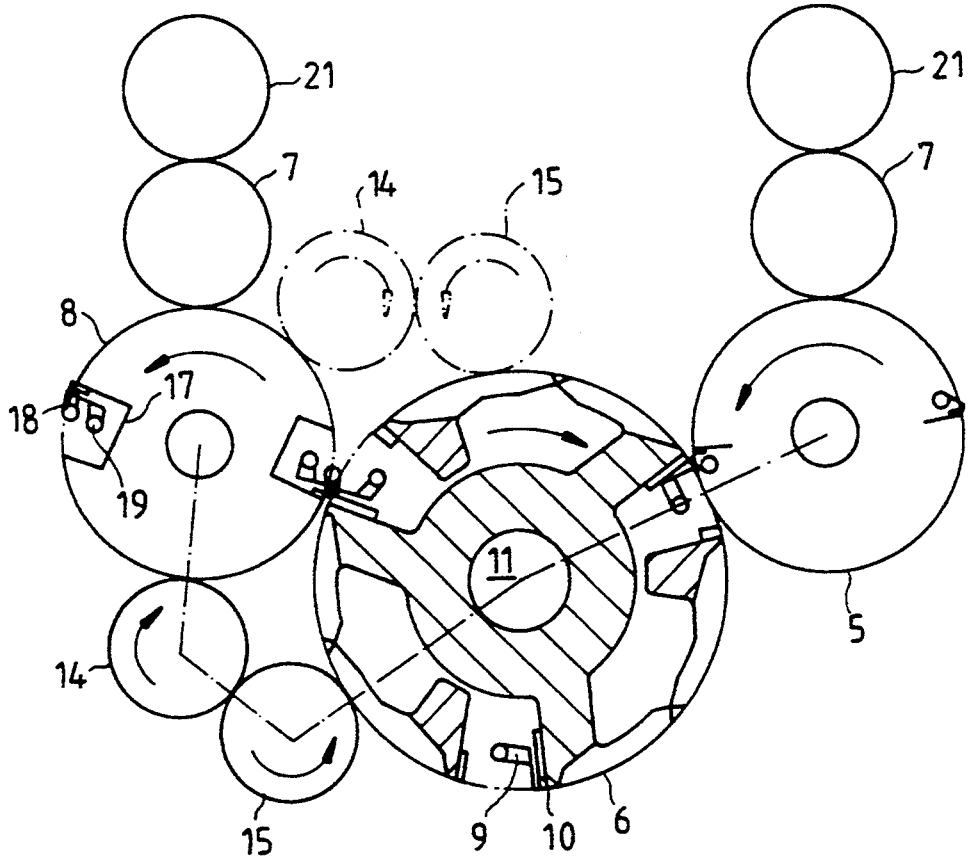
FIG. 2 is a view similar to that of FIG. 1 showing possible arrangements of single-revolution intermediate gears.

FIG. 2 shows possible arrangements of single-revolution intermediate gears. With reference to the rotation arrows indicated in this figure, it is possible to follow the drive flow from the impression cylinder 5, the sheet-guiding cylinder 6, the intermediate gear 15, via the double intermediate gear 14 to the sheet-guiding cylinder 8, which serves as an impression and turning cylinder. The power flow is along the phantom line drawn between the aforementioned components. A further possible arrangement of the single-revolution intermediate gears 14 and 15 is shown by the phantom-line representation of the gears 14 and 15 above the sheet-guiding cylinders 6 and 8. The intermediate gear 14 is once again in the form of a double intermediate gear, with which it is possible to perform a change-over or conversion of the printing press.

Provided above each of the sheet-guiding cylinder 8 serving as an impression cylinder, and the impression cylinder 5 is a rubber-blanket cylinder 7, which is inked by a form cylinder 21. In contrast with the use of half-revolution gearwheels, when single-revolution gearwheels are used as change-over gears, any occurring positional errors are imprinted in identical position on each printed sheet, with the result that they are invisible in the printed product. It is possible, thereby, to prevent ghosting in the printed image, the ghosting, e,g., when using half-revolution gearwheels as change-over gears for double-size storage drums, possibly resulting from the unfavorable summation of take-up play and concentricity tolerances. The use of a drive diversion further makes it possible independently to determine the gap size between the sheet-guiding cylinders 6 and 8 without having to make reference to the requirements of the gearing-correction methods.

Figure 3:
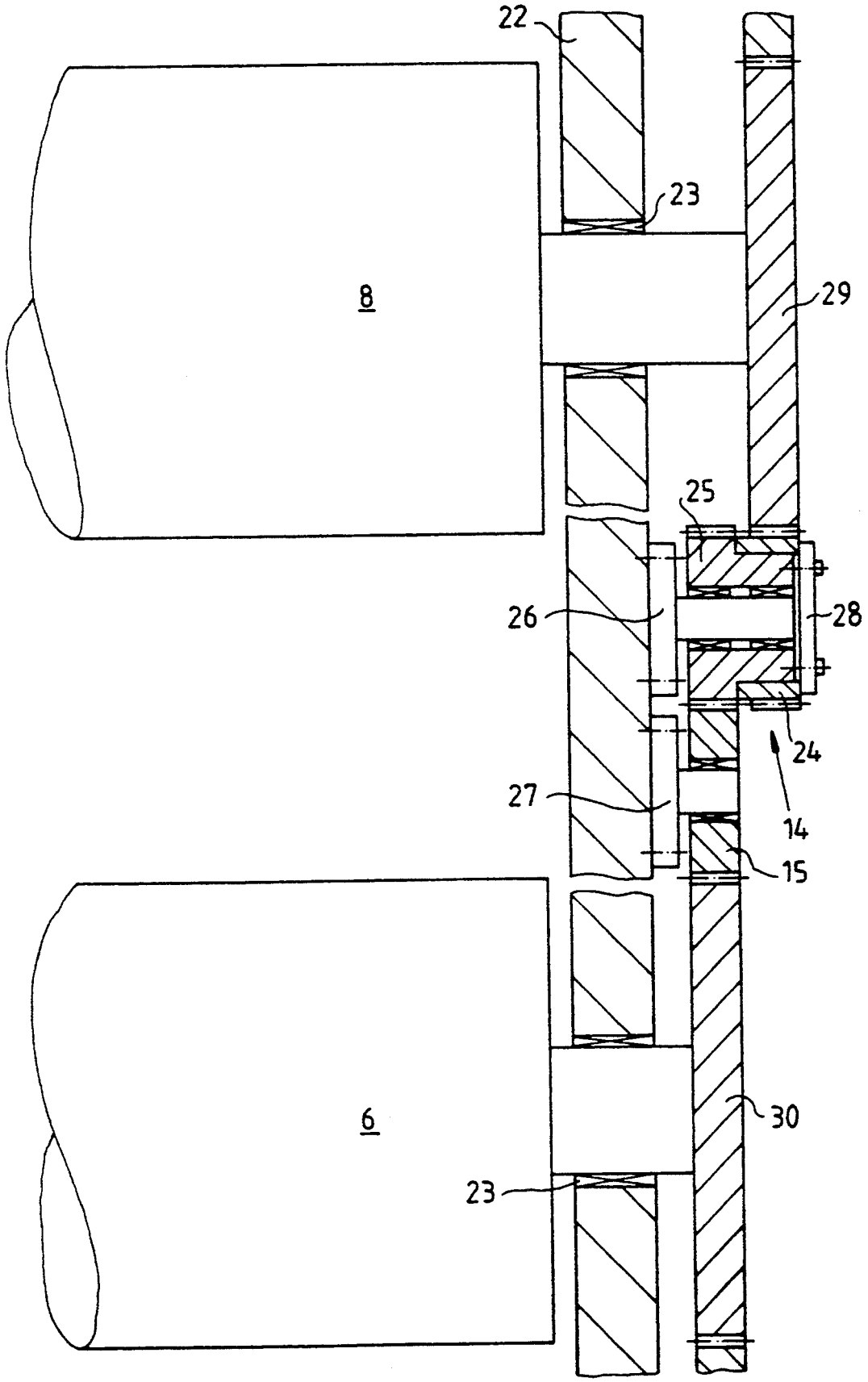
FIG. 3 is a view in a projection plane, partly in section, of a change-over gear train journalled on a side wall.

FIG. 3 is a representation of a change-over gear train on a side wall, the gear train having been rotated into the projection plane of the drawing. The sheet-guiding cylinders 6 and 8 are held in bearings 23 in a side wall 22. Mounted on the journals of the respective cylinders are gearwheels 29 and 30, respectively, having pitch diameters corresponding to the outer diameters of the sheet-guiding cylinders 6 and 8. Flanged onto the side wall 22 are two journal necks 26 and 27, of which the journal neck 26 holds the double intermediate gear 14. As can be seen from FIG. 3, the double intermediate gear 14 is formed of a gearwheel 25, on which a ring gear 24 is movably held and serves to effect the change-over of the printing press from recto-printing mode to recto-and-verso printing mode, or vice versa, as well as a sheet-size or format adjustment. Clamping may be performed, e.g., through the intermediary of a cover 28, as shown in the figure, with the aid of which the ring gear 24 and the gearwheel 25 are fixable in a rotationally locked manner in the respective working positions thereof.

The journal neck 27 holds a single, single-revolution intermediate gear 15, which meshes both with the gearwheel 30 and also with the gearwheel 25 of the single-revolution double intermediate gear 14. If the drive is introduced, e.g., via the gearwheel 30, the drive is transmitted via the single-revolution intermediate gear 15 to the gearwheel 25 of the single-revolution double intermediate gear 14. The latter is clamped through the intermediary of the cover 28 to the adjustable ring gear 24 which, in turn, drives the sheet-guiding cylinder 8 through the intermediary of the gearwheel 29.

Because the change-over or conversion from recto-printing mode to recto-and-verso printing mode is effected with a single-revolution double intermediate gear, the adjustment of which makes ghosting invisible in the printed product, it is possible for the gearwheel and ring gear of the double intermediate gear to be manufactured at lower cost and with reduced demands in terms of tolerances than in the case of half-revolution gearwheels for change-over.

FIGS. 4 and 5 are diagrammatic representations of variations in drive separation on double-size sheet-guiding cylinders.

In the variant embodiment shown in FIG. 4, disposed between two printing units is a turning device formed of the sheet-guiding cylinder 31 serving as a turning drum which, in the case at hand, is associated with a single-revolution intermediate gear 15, which meshes with a single-speed double intermediate gear 14, with which change-over and sheet-size or format adjustment are performed. The drive, bridging the drive separation 35 between the sheet-guiding cylinders 31 and 32, extends from the sheet-guiding cylinder 32 serving as an impression cylinder, via the intermediate gears 14 and 15 and further via the sheet-guiding cylinder 31 acting as a turning drum to the impression cylinder 5.

FIG. 5 shows a turning device formed of the intermediate gears 14 and 15 as well as of a sheet-guiding cylinder 33 constructed as a storage drum and of a sheet-guiding cylinder 8 serving as an impression and turning cylinder. The power flow is analogous to the foregoing example according to FIG. 4 and extends along the phantom line in order to bridge a drive separation 36.

FIG. 6 shows another embodiment of the invention with three double-size sheet-guiding cylinders of a turning device between two printing units.

Situated between the impression cylinders 5 of two printing units represented diagrammatically by the printing-unit cylinders 7 and 21 is a turning device, which is formed of the sheet-guiding cylinder 31 constructed as a turning drum, and the sheet-guiding cylinder 33, as well as of the intermediate gears 14 and 15. Provided between the sheet-guiding cylinders 31 and 33 is a drive separation 37 which, as in the hereinaforedescribed embodiments, is able to be bridged by the intermediate gears 14 and 15. Situated between the impression cylinder 5 and the cylinder acting as the storage drum 33 is a further sheet-guiding cylinder 34, acting as a transfer cylinder. The drive flow is analogous to those of the aforedescribed variations and extends along the phantom line, starting from the impression cylinder 5 to the sheet-guiding cylinder 34, to the sheet-guiding cylinder 33, to the intermediate gears 14 and 15, and to the sheet-guiding cylinder 31 constructed as a turning drum.

Finally, FIGS. 7 and 8 show embodiments of the turning device with intermediate gears of different diameters.

In these embodiments, which resemble those shown in FIGS. 4 and 5, the single-revolution double intermediate gears 14 used for change-over mesh with a half or smaller-revolution intermediate gear 16. In FIG. 7, the turning device is formed of the sheet-guiding cylinders 31 and 32 and the intermediate gears 14 and 16 with, as in FIG. 4, a drive separation 35 between the sheet-guiding cylinders 31 and 32. In this configuration, the sheet-guiding cylinder 32 serves as the impression cylinder of a printing unit and also as a storage drum, while the sheet-guiding cylinder 31 is constructed as a turning drum.

FIG. 8 shows the configuration of a turning device formed of the sheet-guiding cylinder 33 as a storage drum, the single-revolution double intermediate gear 14 serving as a change-over gear, as well as of the half or smaller-speed intermediate gear 16 and a sheet-guiding cylinder 8 serving simultaneously as an impression and turning cylinder. Analogous to the embodiment in FIG. 5, the drive separation 36 extends between the two sheet-guiding cylinders 8 and 33.

The foregoing is a description corresponding in substance to German Application P 42 31 257.4, dated Sep. 18, 1992, the International priority of which is being claimed for the instant application, and which is hereby made part of this application. Any material discrepancies between the foregoing specification and the aforementioned corresponding German application are to be resolved in favor of the latter.

I claim:

1. Sheet-fed rotary printing press for making one-sided multi-color prints or rector-and-verso prints, having at least one multi-size, driven sheet-guiding cylinder disposed between impression cylinders of two printing units, devices adjustable to a sheet-length format, and gripper systems associated with the cylinders, comprising at least two intermediate gears via which a drive of the cylinders is divertable, at least one of said intermediate gears being formed as a single-revolution double intermediate gear having an adjustable ring gear and a gearwheel.

2. Sheet-fed rotary printing press according to claim 1, wherein said one intermediate gear is formed as a single-revolution double intermediate gear for change-over and sheet-format adjustment.

3. Sheet-fed rotary printing press according to claim 1, wherein the other of said two intermediate gears is formed as a single-revolution single intermediate gear.

4. Sheet-fed rotary printing press according to claim 1, wherein the other of said two intermediate gears is formed as a half or slower-revolution intermediate gear.

5. Sheet-fed rotary printing press according to claim 1, including sheet-guiding cylinders mounted in the printing press, and wherein said one intermediate gear is formed as a change-over gear, and both of said intermediate gears are disposed below said sheet-guiding cylinders.

6. Sheet-fed rotary printing press according to claim 1, including sheet-guiding cylinders mounted in the printing press, and wherein said one intermediate gear is formed as a change-over gear, and both of said the intermediate gears are disposed above said sheet-guiding cylinders.

7. Sheet-fed rotary printing press according to claim 5, wherein said sheet-guiding cylinders have outer cylindrical surfaces and are mountable so that said outer cylindrical surfaces thereof define a gearing-independent gap therebetween as a passage for grippers.

8. Sheet-fed rotary printing press according to claim 6, wherein said sheet-guiding cylinders have outer cylindrical surfaces and are mountable so that said outer cylindrical surfaces thereof define a gearing-independent gap therebetween as a passage for grippers.

9. Sheet-fed rotary printing press according to claim 1, including sheet-guiding cylinders and gears mounted in the printing press, the sheet-guiding cylinders including an impression cylinder, a multi-size sheet-guiding cylinder formed as a storage drum, and a sheet-guiding cylinder serving as an impression and turning cylinder, and said gears including single-revolution intermediate gears, a drive of said sheet-guiding cylinders extending from said impression cylinder via said multi-size sheet-guiding cylinder formed as a storage drum, and via said single-revolution intermediate gears to said sheet-guiding cylinder serving as an impression and turning cylinder.

10. Sheet-fed rotary printing press according to claim 1, including sheet-guiding cylinders and gears mounted in the printing press, the gears including two intermediate gears, one of which serves as a change-over gear, said sheet-guiding cylinders having a drive separation therebetween, said drive separation being bridged by said intermediate gear serving as a change-over gear, and by the other of said two intermediate gears.

11. Sheet-fed rotary printing press according to claim 1, including sheet-guiding cylinders and gears mounted in the printing press, wherein said sheet-guiding cylinders include a sheet-guiding cylinder acting as a storage drum, and a sheet-guiding cylinder serving as an impression and turning cylinder of a down-line printing unit, and said gears include intermediate gears, said sheet-guiding cylinders having a drive separation therebetween, and including a drive bridging said drive separation, said drive extending from one of said sheet-guiding cylinders to said sheet-guiding cylinder acting as the storage drum, and via said intermediate gears to said sheet-guiding cylinder serving as the impression and turning cylinder of the downline printing unit.

12. Sheet-fed rotary printing press according to claim 1, including a plurality of multi-size sheet-guiding cylinders disposed between the impression cylinders of the two printing units, said cylinders defining a drive separation therebetween, said drive separation being bridged by an intermediate gear acting as a change-over gear, as well as by another intermediate gear.

13. Sheet-fed rotary printing press according to claim 2, including a plurality of sheet-guiding cylinders mounted in the printing press and defining a drive separation therebetween, said drive separation being bridged by an intermediate gear constructed as a change-over gear, and by another intermediate gear.

14. Sheet-fed rotary printing press according to claim 4, including a plurality of sheet-guiding cylinders mounted in the printing press and defining a drive separation therebetween, said drive separation being bridged by an intermediate gear constructed as a change-over gear, and by another intermediate gear.

* * * * *